US008674275B2

(12) United States Patent
Brundage et al.

(10) Patent No.: US 8,674,275 B2
(45) Date of Patent: Mar. 18, 2014

(54) METHOD OF FABRICATING A HONEYCOMB STRUCTURE USING MICROWAVES

(75) Inventors: Kevin Robert Brundage, Corning, NY (US); Jacob George, Horseheads, NY (US); Elizabeth Marie Vileno, Corning, NY (US)

(73) Assignee: Corning Incorporated, Corning, NY (US)

( * ) Notice: Subject to any disclaimer, the term of this patent is extended or adjusted under 35 U.S.C. 154(b) by 1516 days.

(21) Appl. No.: 11/824,301

(22) Filed: Jun. 29, 2007

(65) Prior Publication Data

US 2009/0166355 A1 Jul. 2, 2009

(51) Int. Cl.
*H05B 6/70* (2006.01)
*B41J 2/32* (2006.01)

(52) U.S. Cl.
USPC ..... 219/693; 219/746; 374/171

(58) Field of Classification Search
USPC ..... 219/678–679, 690–697, 750; 264/432, 264/433, 474, 489; 34/259
See application file for complete search history.

(56) References Cited

U.S. PATENT DOCUMENTS

| | | | | |
|---|---|---|---|---|
| 3,465,114 | A * | 9/1969 | Bleackley et al. | 219/697 |
| 3,843,861 | A * | 10/1974 | Van Amsterdam | 219/696 |
| 5,172,385 | A * | 12/1992 | Forrest et al. | 372/50.21 |
| 5,223,188 | A | 6/1993 | Brundage et al. | 264/26 |
| 5,442,329 | A | 8/1995 | Ghosh et al. | 333/21 R |
| 5,646,489 | A | 7/1997 | Kakehi et al. | 315/111.21 |
| 5,834,744 | A | 11/1998 | Risman | 6/70 |
| 6,472,648 | B2 | 10/2002 | Matsuo et al. | 219/688 |
| 6,652,709 | B1 | 11/2003 | Suzuki et al. | |
| 2001/0019053 | A1 | 9/2001 | Drozd et al. | 219/693 |
| 2002/0093123 | A1 | 7/2002 | Miura et al. | 6/64 |
| 2002/0102738 | A1 | 8/2002 | Jennings et al. | 6/74 |
| 2005/0093209 | A1 | 5/2005 | Bergman et al. | 47/78 |
| 2006/0093209 | A1 | 5/2006 | Guetter et al. | 382/159 |
| 2006/0159795 | A1 | 7/2006 | Bergman et al. | 425/174.6 |

FOREIGN PATENT DOCUMENTS

| | | | |
|---|---|---|---|
| EP | 0 273 707 | 6/1988 | 3/347 |
| EP | 0 564 359 A1 | 10/1993 | 6/70 |
| EP | 0 880 164 A1 | 11/1998 | 37/32 |
| FR | 2 668 676 A2 | 4/1992 | 1/46 |
| FR | 2 804 826 A1 | 8/2001 | 6/72 |
| JP | 2001-130973 | 5/2001 | 35/64 |
| WO | WO 02/100131 | 12/2002 | |
| WO | WO 02/102116 | 12/2002 | |
| WO | WO 03/040630 | 5/2003 | |

OTHER PUBLICATIONS

Sami G. Tantawi, et al., "Evaluation of the TE12 mode in circular waveguide for low-loss, high-power rf transmission", Physical Review Special Topics—Accelerators and Beams, vol. 3, 082001 (2000), pp. 082001-1-082001-21.

* cited by examiner

*Primary Examiner* — Quang Van
(74) *Attorney, Agent, or Firm* — Charles A. Greene; Joseph M. Homa

(57) ABSTRACT

A microwave applicator assembly includes a microwave applicator that excites TE modes and provides a generally circular heating pattern in a lossy dielectric material. The microwave applicator has a processing chamber bounded by a circumferential wall in which a plurality of indents are formed. The microwave applicator assembly may further include a feed waveguide coupled to the microwave applicator for inputting microwaves into the processing chamber. The microwave applicator assembly may further include one or more choking sections in communication with the processing chamber to enhance heating efficiency and reduce microwave leakage.

9 Claims, 7 Drawing Sheets

METHOD OF FABRICATING A HONEYCOMB STRUCTURE USING MICROWAVES

BACKGROUND OF THE INVENTION

The invention relates generally to microwave applicators and systems for heat processing of dielectric materials.

Some dielectric bodies made by extruding plasticized deformable material using liquid as part of the plasticizing system may not have enough strength when wet to be self-supporting. To strengthen the extrudate, the extrusion process can be followed by a stiffening process, whereby the extrudate is heated to a selected temperature, for example, above a gelling point of a thermally-activated binder in the plasticizing system. Such a stiffening process is described in, for example, U.S. Pat. No. 5,223,188 issued to Brundage et al and U.S. Patent Application Publication No. US2006/0093209 by Bergman et al. In the Brundage et al patent and the Bergman et al publication, microwaves are used to heat the extrudate. Microwave heating is attractive for heating and stiffening dielectric bodies because microwaves can penetrate dielectric materials and provide heat to the interior of a volume.

SUMMARY OF THE INVENTION

In one aspect, the invention relates to a microwave applicator assembly which comprises a microwave applicator that excites TE modes and provides a generally circular heating pattern in a lossy dielectric material. The microwave applicator has a processing chamber bounded by a circumferential wall in which a plurality of indents are formed. In some embodiments, the plurality of indents are positioned on the circumferential wall to encourage excitation of TE modes and establish the generally circular heating pattern. In some embodiments, the microwave applicator assembly further comprises a feed waveguide, preferably of rectangular cross-section, coupled to the microwave applicator for inputting microwaves into the processing chamber. In some embodiments, the feed waveguide supports the $TE_{10}$ mode. The processing chamber is further bounded by opposing end walls having openings for receiving the dielectric material. In some embodiments, the microwave applicator assembly further comprises a choke coupled to at least one of the end walls and in communication with the processing chamber through the opening in the at least one of the end walls. The choke may comprise an air bearing support for the dielectric material. In some embodiments, chokes may be coupled to both end walls and in communication with the processing chamber through the openings in the end walls. The microwave applicator assembly may further comprise an insert disposed in the processing chamber to provide a barrier between the processing chamber and the dielectric material.

In another aspect, the invention relates to a microwave system which comprises a microwave applicator assembly as described above and a microwave source coupled to the feed waveguide.

In yet another aspect, the invention relates to the combination of an extruder and a microwave applicator assembly, such as the microwave applicator assembly described above, arranged to receive a dielectric material from an extrusion die of the extruder, wherein the microwave applicator assembly physically contacts the extruder. In some embodiments, the distance between opposing end walls of the microwave applicator of the microwave applicator assembly and the extruder die is less than or equal to 5 in. (12.7 cm).

In another aspect, the invention relates to a method of fabricating a honeycomb structure which comprises extruding a green honeycomb structure and exposing the green honeycomb structure to microwave energy in a microwave applicator that excites TE modes and provides a generally circular heating pattern in a lossy dielectric material in order to stiffen the green honeycomb structure. In some embodiments, the microwave applicator has a processing chamber bounded by a circumferential wall in which a plurality of indents are formed. In some embodiments, the green honeycomb structure emerges from the microwave applicator with less than 10% decrease in moisture level. The green honeycomb structure may be supported on an air bearing while it is being exposed to the microwave energy. The method may comprise cutting the green honeycomb structure transversely after exposure to the microwave energy. The method may comprise drying the green honeycomb structure. The method may further comprise firing the green honeycomb structure into a ceramic honeycomb structure.

Other features and advantages of the invention will be apparent from the following description and the appended claims.

BRIEF DESCRIPTION OF THE DRAWINGS

The accompanying drawings, described below, illustrate several embodiments of the invention and are not to be considered limiting of the scope of the invention, for the invention may admit to other equally effective embodiments. The figures are not necessarily to scale, and certain features and certain view of the figures may be shown exaggerated in scale or in schematic in the interest of clarity and conciseness.

DETAILED DESCRIPTION OF THE INVENTION

Figure 1:
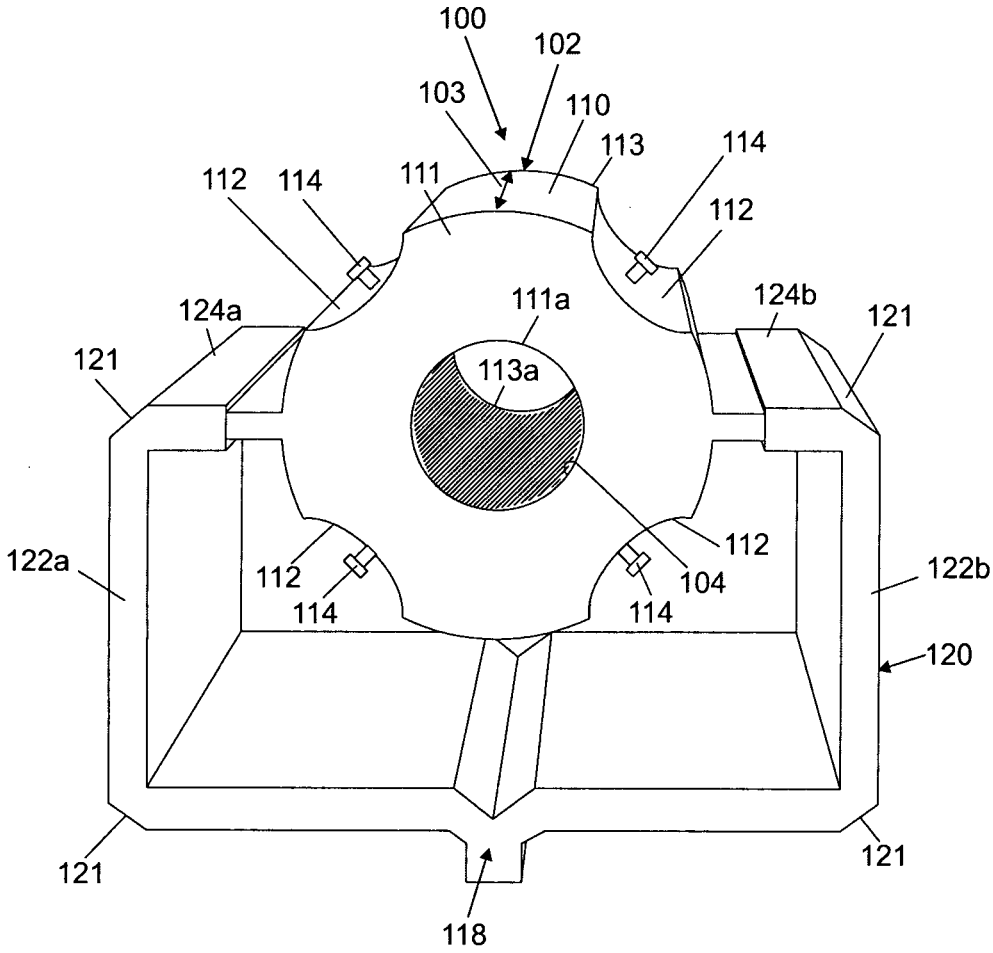
FIG. 1 is an isometric view of an embodiment of a microwave applicator assembly as disclosed herein.

The invention will now be described in detail with reference to several embodiments, as illustrated in the accompanying drawings. In describing the embodiments, numerous specific details are set forth in order to provide a thorough understanding of the invention. However, it will be apparent to one skilled in the art that the invention may be practiced without some or all of these specific details. In other instances, well-known features and/or process steps have not been described in detail so as not to unnecessarily obscure the invention. In addition, like or identical reference numerals are used to identify common or similar elements.

Figure 2:
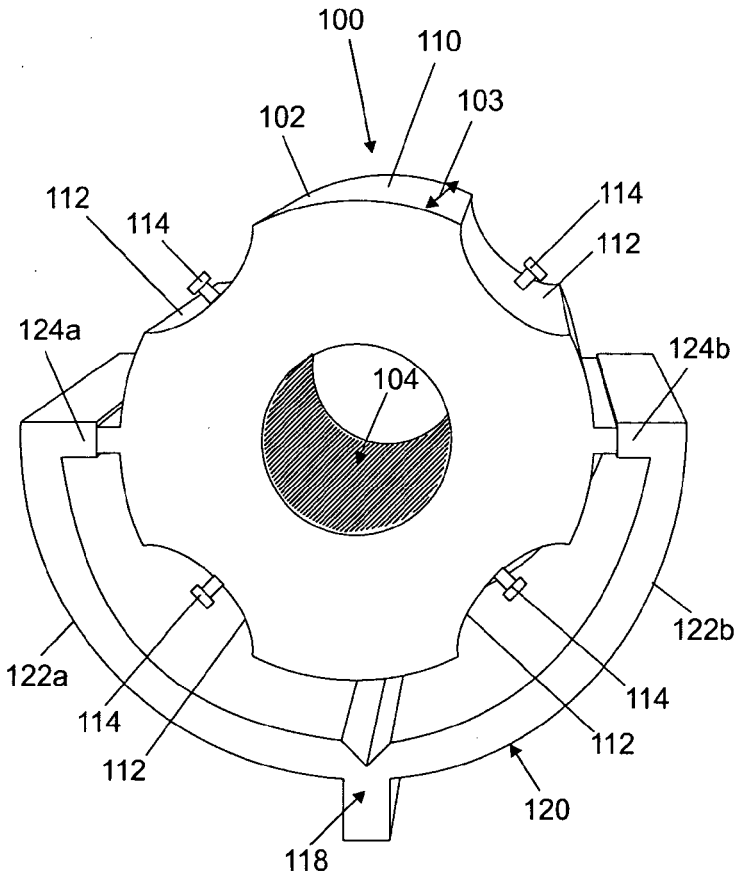
FIG. 2 is an isometric view of the embodiment of the microwave applicator assembly of FIG. 1 with modifications to the feed waveguide.

FIGS. 1 and 2 depict examples of a microwave applicator assembly 100 comprising a microwave applicator 102 for heat processing of a lossy dielectric material (not shown), i.e., a material that heats up as it absorbs microwave energy. The lossy dielectric material may be a single ware or a continuous extrudate or a continuous flow of dielectric material. In one example, the lossy dielectric material forms a honeycomb matrix or other cellular structure. The microwave applicator 102 is configured to provide a generally circular heating pattern in the lossy dielectric material. The heating pattern is circular in a transverse plane preferably perpendicular to the longitudinal axis of the microwave applicator 102. The heating pattern is also preferably uniform on the transverse plane. The microwave applicator 102 comprises a processing chamber 104 bounded by an outer circumferential wall 110 and end walls 111, 113. The circumferential wall 110 has a generally deformed cylindrical shape. The end walls 111, 113 are spaced apart in opposing relation and are preferably generally planar. Openings 111*a*, 113*a* are provided in the end walls 111, 113 for access to the processing chamber 104. The openings 111*a*, 113*a* are axially aligned and generally define a longitudinal passage at the center of the processing chamber 104 for passage of the lossy dielectric material. One or more tuning stubs 114 may be inserted into the microwave applicator 102, wherein they project into the processing chamber 104, in order to adjust the shape of the electromagnetic fields inside the microwave applicator 102 and/or tune the microwave applicator 102 precisely to the desired operating frequency. Indents 112 are formed along the circumferential wall 110 of the processing chamber 104. The indents 112 extend substantially across the axial length 103 of the microwave applicator 102, and preferably extend entirely across the axial length 103 of the microwave applicator 102. The microwave applicator 102 excites transverse-electric (TE) modes. The indents 112 are positioned strategically on the circumferential wall 110 to encourage excitation of the TE modes to establish a circular heating pattern in a lossy dielectric material disposed in the center of the microwave applicator 102. The indents 112 may also provide other functions, such as increasing the surface area for currents in the circumferential wall 110, thereby allowing the microwave applicator 102 to be made compact and to process a wide range of size and density materials. The indents 112 may have any suitable profile to establish the generally circular heating pattern inside the processing chamber 104. For example, FIGS. 1 and 2 show the indents 112 as having a generally elliptical profile, i.e., a contour in a transverse plane which is described generally by an ellipse, or part of an ellipse. In other embodiments, the indents 112 may have a generally circular profile or a rounded rectangle is the profile.

The microwave applicator assembly 100 further comprises a feed waveguide 120 for inputting microwaves into the microwave applicator 102. In some embodiments, such as in FIGS. 1 and 2, the feed waveguide 120 is a hollow waveguide having a rectangular cross-section and supporting the $TE_{10}$ mode. The feed waveguide 120 comprises a feed waveguide inlet port 118, which is connected to distributor arms 122*a*, 122*b* that terminate at feed waveguide outlet ports 124*a*, 124*b*, respectively. The feed waveguide outlet ports 124*a*, 124*b* are coupled to the circumferential wall 110 at diametrically-opposed positions on the circumferential wall 110. The feed waveguide 120 may have more than one feed waveguide inlet port 118. The feed waveguide inlet port 118 is an E-plane split that splits received microwaves into the distributor arms 122*a*, 122*b*. Microwaves in the distributor arms 122*a*, 122*b* enter the processing chamber 104 of the microwave applicator 102 through the feed waveguide outlet ports 124*a*, 124*b*. The distributor arms 122*a*, 122*b* may be made of planar surfaces, as shown in FIG. 1, or may be made of curvilinear surfaces, as shown in FIG. 2, or may be made of a combination of planar and curvilinear surfaces. Where the distributor arms 122*a*, 122*b* are made of planar surfaces, as shown in FIG. 1, the distributor arms 122*a*, 122*b* may comprise mitered bends 121 to prevent reflection of microwaves in the distributor arms 122*a*, 122*b* back toward the source. The feed waveguide 120 may have more or less than two feed waveguide outlet ports. For example, the feed waveguide 120 may have a ring-shaped distributor with a plurality of feed waveguide outlet ports extending between the distributor and the microwave applicator 102.

To maintain a TE mode and suppress transverse-magnetic (TM) mode inside the microwave applicator 102, the axial length 103 of the microwave applicator 102 is preferably in a range from 50% to 70% of the free-space wavelength. For a circular heating pattern, a quasi $TE_{0n}$ mode is created in the microwave applicator 102. To do this, the microwave applicator 102 is considered as operating in a certain $TE_{0n}$ mode. For a selected $TE_{0n}$ mode, the outer diameter (D in FIG. 3) of the microwave applicator 102 is selected to be larger than the minimum size supported by that mode, but smaller than the next higher-order TE mode. For illustration purposes, consider a microwave applicator 102 operating in the $TE_{03}$ mode. The next higher order mode for $TE_{03}$ mode is $TE_{52}$. In this embodiment, the outer diameter (for example, D in FIG. 3) of the microwave applicator 102 would be:

$$D_{TE_{52}} = \frac{X_{(TE_{52})} \times c}{\nu\pi\sqrt{\varepsilon_{reff}}} > D > D_{TE_{03}} = \frac{X_{(TE_{03})} \times c}{\nu\pi\sqrt{\varepsilon_{reff}}} \tag{1}$$

$$D_{TE_{52}} = \frac{10.5199 \times 3 \times 10^8}{2450 \times 10^6 \times \pi\sqrt{\varepsilon_{reff}}} > D > D_{TE_{03}} = \frac{10.1735 \times 3 \times 10^8}{2450 \times 10^6 \times \pi\sqrt{\varepsilon_{reff}}} \tag{2}$$

where $\in_{reff}$ is the effective volume weighted average relative permittivity of the solid dielectric and the air filling the processing chamber, $X_{(TE_{52})}$ is the $2^{nd}$ zero of the derivative of the Bessel function of the first kind of order 5, $X_{(TE_{03})}$ is the $3^{rd}$ zero of the derivative of the Bessel function of the first kind of order 0, ν is the frequency of operation and c is the speed of light in free space. The preferred value for D is:

$$D = \frac{D_{TE_{52}} + D_{TE_{03}}}{2} \tag{3}$$

Figure 3:
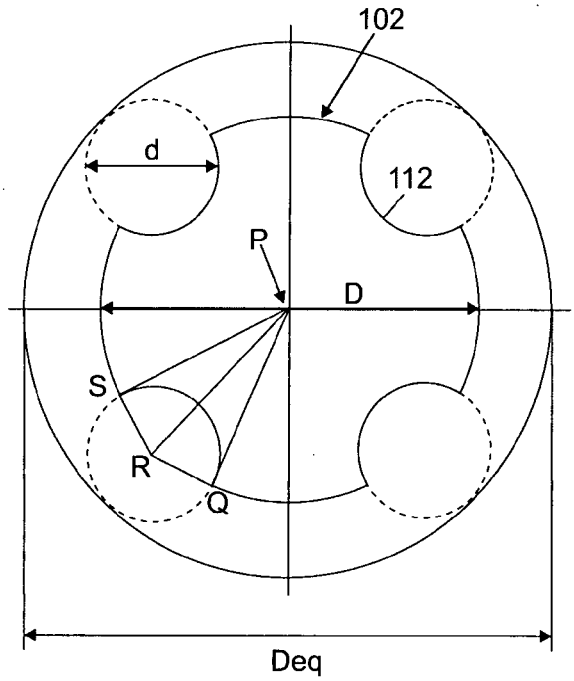
FIG. 3 is a diagram depicting parameters for an embodiment of a microwave applicator as disclosed herein.

For an embodiment where the indents 112 have a circular profile and equal diameters, the diameter of each indent 112 is determined by two factors: (1) the equivalent diameter ($D_{eq}$ in FIG. 3) of the microwave applicator 102 with the embedded indents 112, assuming the indents are full circles, and (2) the resulting volume weighted average effective dielectric constant of the applicator with the embedded indents. The diameter and location of the indents 112 are determined in such a way that they satisfy the following expression:

$$\pi D_{eq}=\pi D+2\angle QRS\times d-2\angle QPS\times D \quad (4)$$

where d is the diameter of the indent 112. The parameters d, $D_{eq}$, D, Q, R, and S are indicated in FIG. 3. In one example, $D_{eq}$ satisfies the condition that the $TE_{52}$ cutoff frequency of the equivalent feed waveguide is approximately 2450 MHz. However, it is possible to select $D_{eq}$ such that it satisfies a different cutoff frequency.

Figure 4:
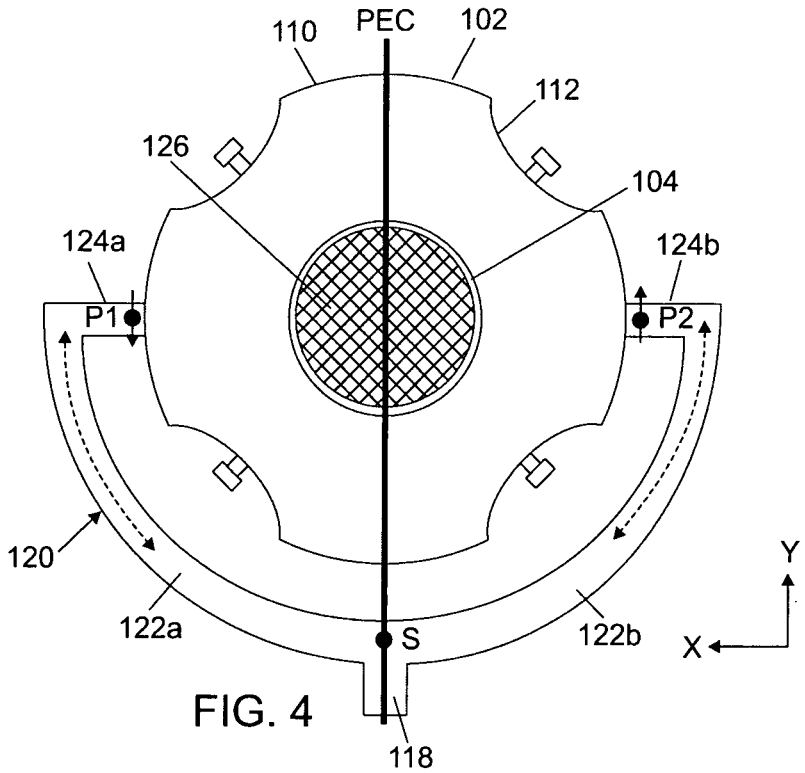
FIG. 4 is a diagram depicting the electric field polarizations at the microwave entry point of the microwave applicator assembly of FIG. 2.

FIG. 4 shows a dielectric material 126 disposed in the processing chamber 104 of the microwave applicator 102. In the example where the predominant mode in the feed waveguide 120 is the $TE_{10}$ mode, the electric field component at points P1 and P2 in the feed waveguide outlet ports 124*a*, 124*b*, respectively, is $E_y$. The points P1 and P2 are equidistant from source S at the feed waveguide inlet port 118. The electric field at points P1 and P2 also has the following characteristics. There exists a perfect electric conductor (PEC) symmetry plane, depicted by PEC in FIG. 4, where the symmetrical components of electric field parallel to and equidistant from the PEC plane are equal and opposite. PEC means that the electric field has electrical symmetry. The phase difference between microwaves arriving at P1 and P2 is obtained by calculating the angle between the two electric field vectors:

$$E_{p1}=i\cdot(E_x=0)+j\cdot(-E_y)+k\cdot(E_z=0) \quad (5)$$

$$E_{p2}=i\cdot(E_x=0)+j\cdot(E_y)+k\cdot(E_z=0) \quad (6)$$

where j and k are the unit vectors along the y and z directions. The angle between them is given by:

$$\theta_{P1-P2}=a\cos\left(\frac{E_{P1}\cdot E_{P2}}{|E_{P1}||E_{P2}|}\right)=a\cos(-1)=\pi \quad (7)$$

In equation (7), only the electric field component in the Y direction exists due to the assumption that the $TE_{10}$ mode exists inside the feed waveguide 120 as the predominant mode. The bold faced dot in equation (7) stands for the vector dot product.

Figure 5:
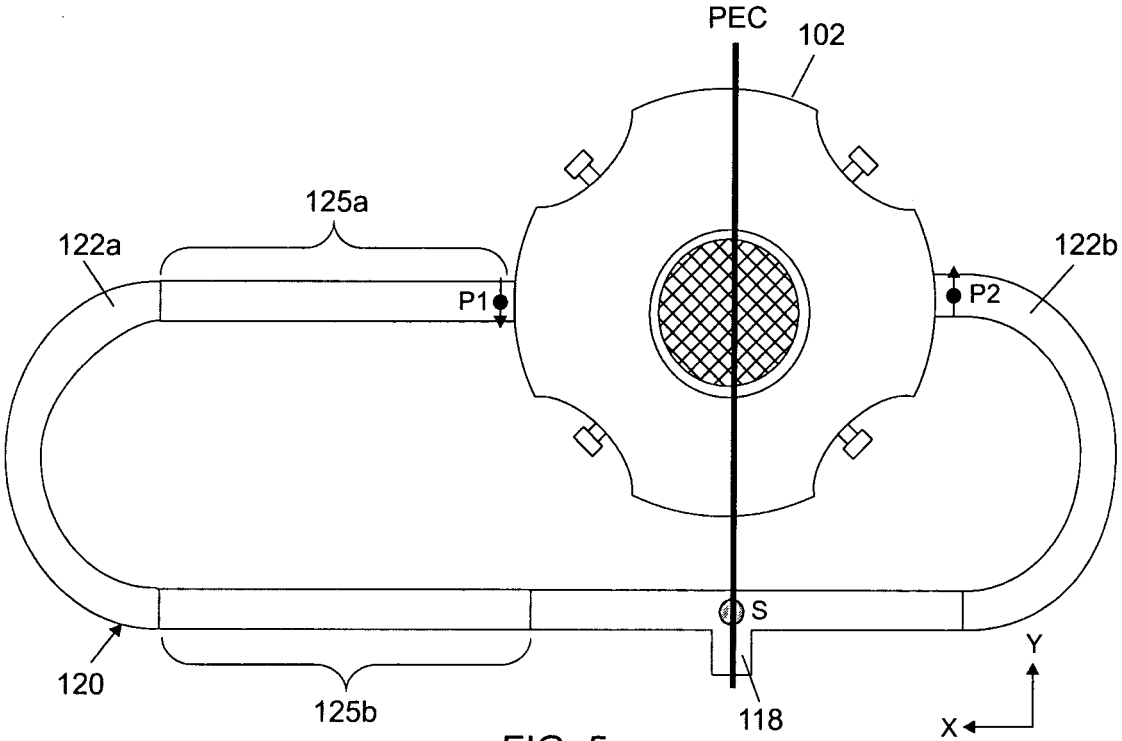
FIG. 5 is a diagram depicting the electric field polarizations at the microwave entry point of a modification of the microwave applicator of FIG. 2.

Adding integral multiples of wavelength of the feed waveguide 120 to either or both of the distributor arms 122*a*, 122*b* will not affect the phase at P1 and P2. This is demonstrated in relation to FIG. 5. In FIG. 5, the distributor arms 122*a*, 122*b* are of unequal length, with the distributor arm 122*a* having arm extensions 125*a*, 125*b*. The arm extensions 125*a*, 125*b* have a path length difference equal to an integral multiple of the wavelength of the feed waveguide 120. The path length of the arm 125*a* may be represented by $m\lambda_g$ and the path length of the arm 125*b* may be represented by $n\lambda_g$, where m, n=0, 1, 2, . . . , and are not necessarily equal, and $\lambda_g$ is the wavelength of the feed waveguide 120. Even though the arms 122*a*, 122*b* are of unequal length, the microwave applicator 102 still has PEC symmetry because the fields at P1 and P2 are equal and opposite.

Figure 6:
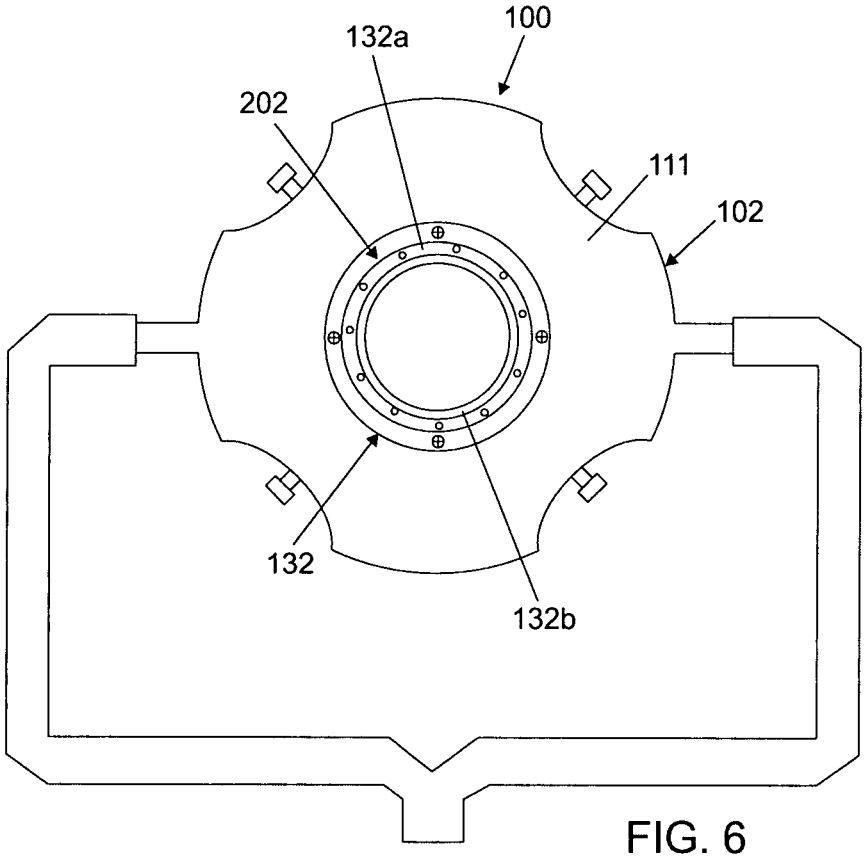
FIG. 6 is an end view of the embodiment of the microwave applicator assembly of FIG. 1 with chokes.
Figure 7:
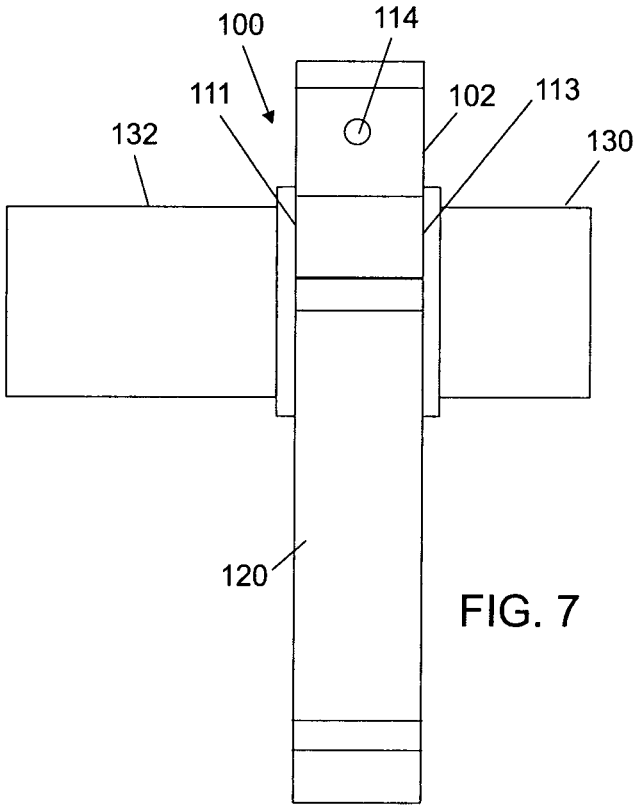
FIG. 7 is a side view of the embodiment of the microwave applicator assembly of FIG. 6.

FIGS. 6 and 7 show the microwave applicator assembly 100 with inlet and outlet chokes 130, 132 coupled to the end walls 113, 111, respectively, of the microwave applicator 102 and in communication with the processing chamber 104 through the openings (113*a*, 113*b* in FIG. 1) in the end walls. The inlet choke 130 serves as a passage through which a dielectric material (not shown) can be inserted into the microwave applicator 100, while the outlet choke 132 is arranged to receive a lossy dielectric material after heating of the material inside the microwave applicator 102. The outlet choke 132 provides additional opportunity for the microwaves emanating from the microwave applicator 102 to heat the dielectric material. The additional length of the outlet choke 132 at the end of the microwave applicator 102 provides an opportunity to reduce microwave leakage from the microwave applicator assembly 100. The inlet choke 130 may perform a similar function at the inlet end of the microwave applicator 102. The axial length of the inlet and outlet chokes 130, 132 may be different as shown, or may be the same.

The outlet choke 132 comprises an outer tube 132*a* and an inner tube 132*b*. Preferably, these tubes are made of a metallic material. The outer tube 132*a* may comprise a flanged end which can be attached to the end wall 111 via any suitable means. The inner diameter of the inner tube 132*b* generally matches the diameter of the opening in the end wall 111 of the processing chamber 104, but at least is sized to receive the dielectric material from the microwave applicator 102. Perforations (not visible in the drawing) can be provided in the inner tube 132*b*, thereby allowing the inner tube 132*b* to function as an air bearing support, that is, when air is provided to the perforations. In this embodiment, the outer tube 132*a* comprises orifices which may be connected to an air source (not shown) and may allow air to be communicated to the inner tube 132*b*. In one example, when the dielectric material exits the microwave applicator 102 into the outlet choke 132, it is received in an air bearing support provided by the inner tube 132*b*. The inlet choke 130 may have a similar design to the outlet choke 132.

Figure 8:
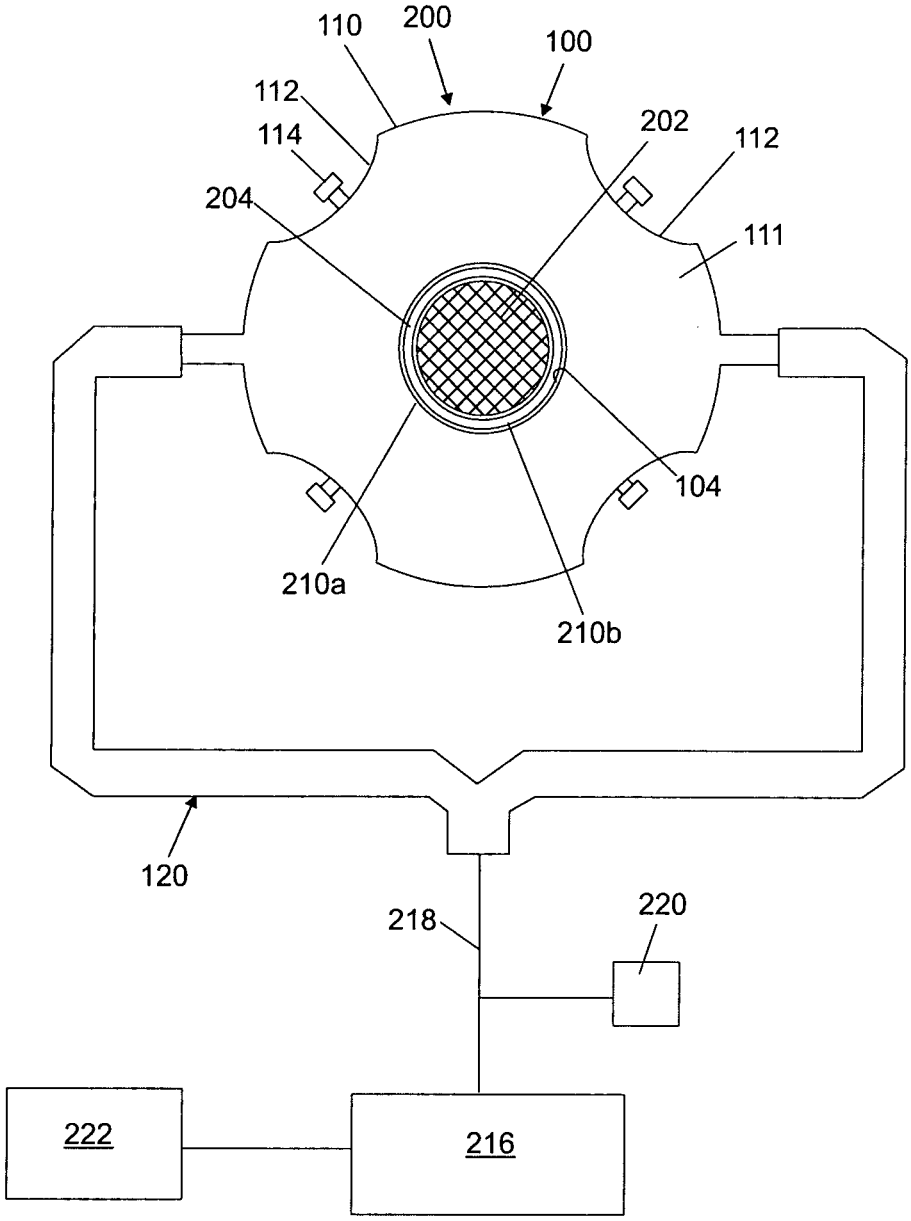
FIG. 8 is an end view of a microwave system including the embodiment of the microwave applicator assembly of FIG. 1.

FIG. 8 depicts a microwave system 200 comprising the microwave applicator assembly 100 and a lossy dielectric material 202 disposed in the microwave applicator 102. An insert 204 is disposed between the dielectric material 202 and the processing chamber 104. The insert 204 may function as a barrier layer between the dielectric material 202 and the processing chamber 104 to keep the processing chamber 104 clean and/or to maintain a low-humidity boundary between the processing chamber 104 and the dielectric material 202. Perforations (not visible in the drawing) may be provided in the wall of the insert 204 and used to supply air in between the insert 204 and the dielectric material 202 in order to provide an air bearing support for the dielectric material 202. In this embodiment, ports (not visible in the drawing) can be provided in the wall of the processing chamber 104 for supplying air into the processing chamber 104 and then the perforations in the insert 204. Air in the processing chamber 104 does not interfere with the electromagnetic fields inside the processing chamber 104. The insert 204 may be cylindrically shaped. The insert 204 may be made of a non-lossy material such as TEFLON. In addition to providing a barrier between the processing chamber 104 and the dielectric material 202, the diameter of the insert 204 can be selected based on the diameter of the dielectric material 202 to stabilize impedance match within the microwave applicator 102. Chokes can be coupled to either ends of the microwave applicator 102 as described above with respect to FIGS. 6 and 7.

The microwave system 200 also comprises microwave source 216 coupled to the feed waveguide 120 of the microwave applicator assembly 100 via suitable coupling device(s), such as waveguide 218 and impedance-matching device 220. The microwave source 216 may transmit microwaves in a frequency range of 100 MHz to 30 GHz, preferably in a range from 430 MHz to 6000 MHz. Preferably the microwave source 216 is capable of transmitting microwaves at 896 MHz, 915 MHz, and 2450 MHz. The microwave source 216 can comprise any appropriate microwave source, such as a magnetron, klystron, traveling wave tubes, and oscillator. The microwave system 200 also comprises a power supply and controller 222 for controlling and adjusting microwaves delivered to the microwave applicator 102. In operation, microwaves are provided to the processing chamber 104 of the microwave applicator 102 through the feed waveguide 120. The microwaves enter into a specially modified interaction space characterized by the indents 112 embedded in the circumferential wall 110 of the microwave applicator 102.

Figure 9:
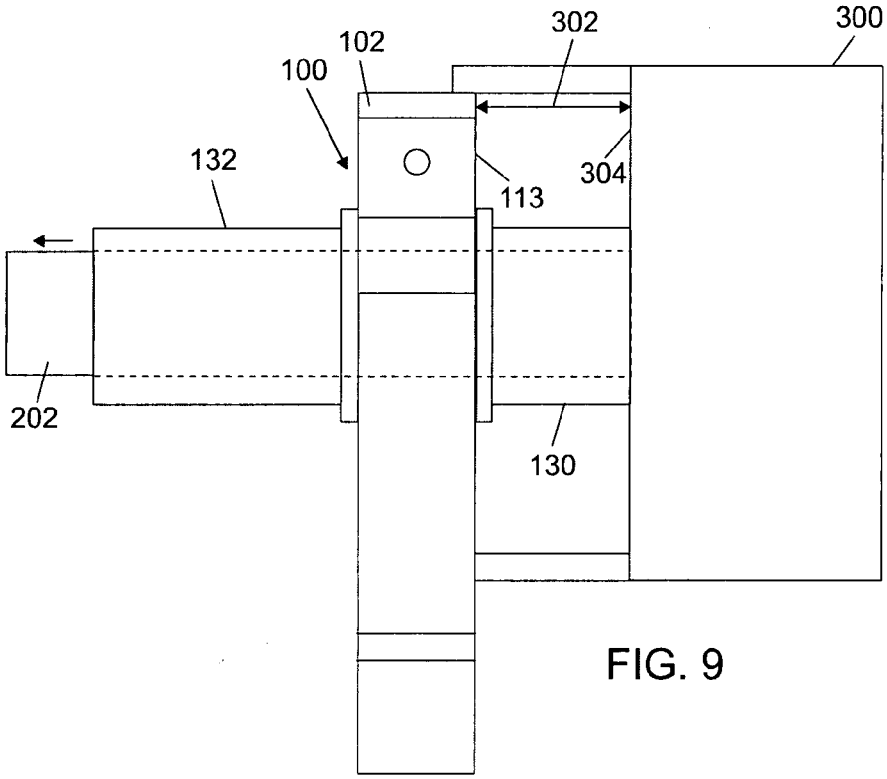
FIG. 9 is a side view of a combination of the microwave applicator assembly of FIG. 1 and an extruder (shown in part).
Figure 10:
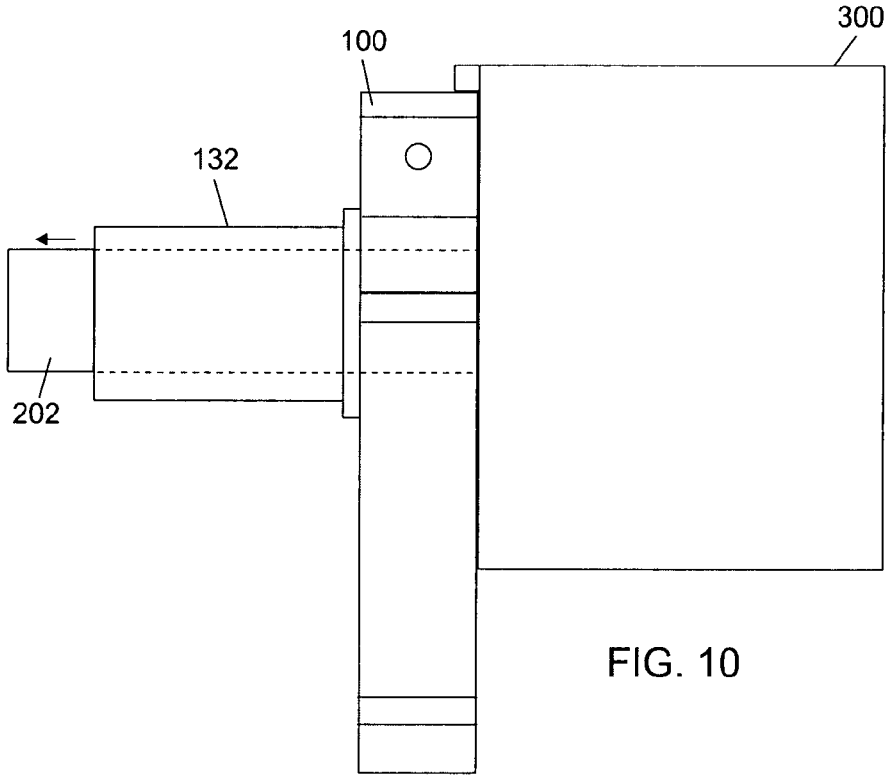
FIG. 10 is a side view of the combination of the microwave applicator assembly and extruder of FIG. 9 without an inlet choke.

FIGS. 9 and 10 depict a combination of the microwave applicator assembly 100 and an extruder 300 which includes an extrusion die. The microwave applicator assembly 100 is coupled to the extruder 300 such that an extrudate emerging from the exit end wall 304 of the extrusion die of the extruder 300 is received in the microwave applicator 102. Preferably, the microwave assembly 100 and the extruder 300 are close to, or more preferably physically contact each other. In one example of the microwave assembly 100 and the extruder 300 being in physical contact, the inlet end wall 113 of the microwave applicator 102 is placed adjacent to and in opposing relation to the exit end wall 304 of the extruder 300 with or without the presence of the inlet choke 130. Where the inlet choke 130 is absent at the inlet end wall 113 of the microwave applicator 102, the inlet end wall 113 of the microwave applicator 102 would be in physical contact with the exit end wall 304 of the extruder 300. Where the inlet choke 130 is present at the inlet end wall 113 of the microwave applicator 102, the inlet choke 130 would be in physical contact with the exit end wall 304 of the extruder. In one example, the distance between the inlet end wall 113 of the microwave applicator 102 and the exit end wall 304 of the extruder die is less than or equal to 5 in. (12.7 cm). In this embodiment, if the inlet choke 130 is disposed between the inlet end wall 113 and the exit end wall 304, the axial length of the inlet choke 130 would have to be selected such that the above criterion is satisfied. The advantage of the tightly spaced relationship between the extruder 300 and the microwave applicator assembly 100 is that the heating process of the extrudate (dielectric material) via microwave energy is brought much closer to where the extrudate emerges from the extrusion die of the extruder 300, where the extrudate has undergone little to no physical deformation, thereby reducing skin and matrix defects in the final product. Additionally, the system combination can be made more compact. In the system combination shown in FIGS. 9 and 10, the extrudate emerging from the extrusion die of the extruder 300 may be a ceramic-forming extrudate made of plasticized deformable material using liquid as part of the plasticizing system and including a thermally-activated binder with a gel point. In the microwave applicator 102, the extrudate would be heated to a temperature to promote stiffening and to prevent skin defects. Heating to a temperature above the gel point of the thermally-activated binder in the extrudate is preferable. Preferably, the extrudate is not completely dried after passing through the microwave applicator 102.

A method of fabricating a ceramic honeycomb structure as disclosed herein comprises extruding a green ceramic honeycomb structure using, for example, the extrusion die of extruder 300. The flow of the plasticized deformable material through the extrusion die pushes the green honeycomb structure into the processing chamber of the microwave applicator 102, where the green honeycomb structure is heated by microwave energy to promote stiffening of the green honeycomb structure. While some moisture may be removed from the green honeycomb structure, the green honeycomb structure is preferably not completely dried in the processing chamber of the microwave applicator disclosed herein. Preferably, the green honeycomb structure emerges from the microwave applicator 102 with less than 10% decrease in moisture level; in some embodiments less than 5% of the water in the green honeycomb structure is removed during processing in the microwave applicator disclosed herein. The green honeycomb structure is further moved through the outlet choke 132 by the action of the extrudate at the inlet end which exits extrusion die 300. As the green honeycomb structure emerges from the choke 132, it can be cut transversely into smaller pieces. Thus, the microwave applicator 102 can process a green honeycomb structure having an axial length longer than the axial length of the microwave applicator 102. Further, the green honeycomb structure translates through the microwave applicator 102 as it is processed. Inside the outlet choke 132, the green honeycomb structure is supported on an air bearing, as previously described. The green honeycomb structure may also be supported on an air bearing inside the processing chamber of the microwave applicator 102 as previously described. The stiffened green honeycomb structure is subsequently dried and fired to form a ceramic honeycomb structure.

The microwave applicator 102 provides a generally circular heating pattern in a lossy dielectric material processed therein, which can lead to greater structural preservation of the dielectric material. The microwave applicator 102 preferably enables extrusion of delicate dielectric bodies without deformation and/or skin defect. The microwave applicator 102 can allow for batch materials having higher water content to form the extrudate, which allows for higher throughput. The microwave applicator 100 can be scaled, using appropriately chosen input wavelengths, to account for diameter of the dielectric body and variations in properties of the dielectric body. For example, 2450 MHz can be used for dielectric bodies having diameters in a range from 2 in. to 7 in., while 915 MHz can be used for dielectric bodies having diameters in a range from 7 in. to 19 in., although both frequencies can be used for the full range of 2 in. to 19 in. In the embodiment of an extrudate containing thermal set binders, the microwave applicator 102 provides circular heating patterns throughout the body of the moving dielectric material to provide enough energy to help prevent deformation and/or skin defects before reaching the next processing step, e.g., drying. Sufficient control on the power is preferred such that the material does not dry out.

Figure 11:
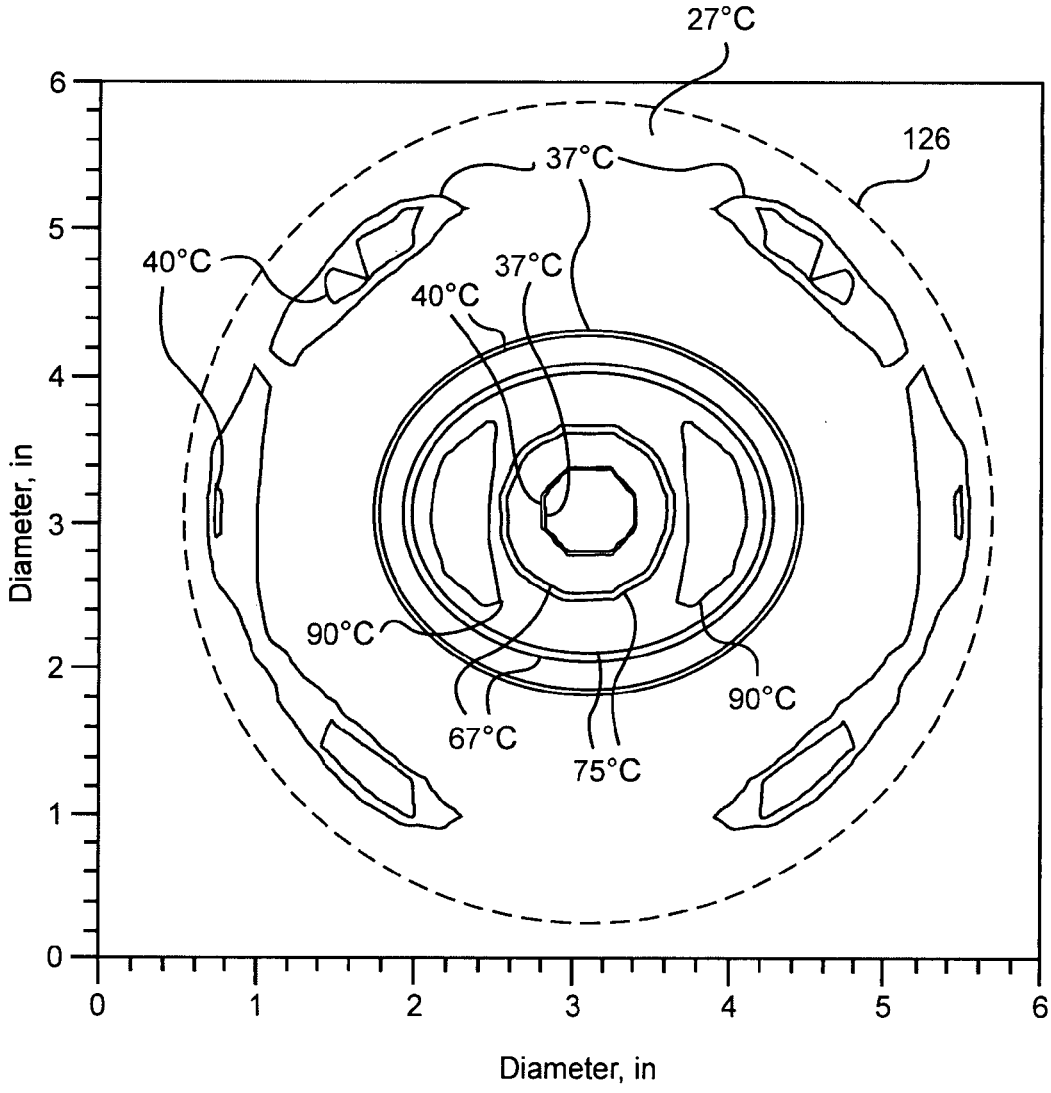
FIG. 11 diagrammatically illustrates calculated isotherms for a ceramic forming green extrudate heated by the microwave applicator assembly of FIG. 1 showing a generally circular heating pattern in the extrudate.

FIG. 11 diagrammatically illustrates calculated isotherms for one embodiment of a ceramic-forming green honeycomb extrudate heated by the microwave applicator assembly of FIG. 1 showing a generally circular heating pattern in the extrudate. The extrudate 126 is a lossy dielectric material and has a total transverse diameter of 5.66 inches (14.4 cm) and a total transverse raidus of 2.83 inches (7.2 cm). The center and the outer periphery (shown in dashed line) of the extrudate 126 are 27° C. For a generally circular heating pattern, the temperature of the lossy material (whether an extrudate, or a discrete piece of ware, or portions thereof) at a given radius of the lossy material over preferably at least 25%, more preferably at least 50%, and even more preferably at least 75% of the total transverse cross-sectional area of the lossy material which is disposed in or near the applicator has a temperature variation (i.e. an azimuthal temperature variation) of preferably less than 10° C., more preferably less than 5° C.; in some embodiments, the azimuthal temperature variation is 0° C. (at a given radius) over preferably at least 25%, more preferably at least 50%, and even more preferably at least 75% of the total transverse cross-sectional area of the lossy material which is disposed in or near the applicator. In some embodiments, the temperature of the lossy material which is disposed in or near the applicator varies by preferably less than 10° C., and more preferably less than 5° C., over preferably at least 25%, more preferably at least 50%, and even more preferably at least 75%, of the total radial width of the dielectric material, i.e. the azimuthal temperature variation of the lossy material which is disposed in or near the applicator is preferably less than 10° C., and more preferably less than 5° C., over preferably at least 25%, more preferably at least 50%, and even more preferably at least 75%, of the total radial width of the dielectric material.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of fabricating a honeycomb structure comprising:

extruding a green honeycomb structure; and exposing the green honeycomb structure to microwave energy in a microwave applicator assembly that excites a single TE mode, the $TE_{03}$ mode, and provides a generally circular heating pattern in the green honeycomb structure, thereby stiffening the green honeycomb structure, wherein the azimuthal temperature variation of green honeycomb structure is less than 10° C. over at least 25% of the total transverse cross-sectional area of the green honeycomb structure.

2. The method of claim 1, wherein the microwave applicator assembly comprises a microwave applicator comprised of a circumferential wall having a plurality of indents, the microwave applicator defining a processing chamber adapted to receive the green honeycomb structure.

3. The method of claim 1, wherein the microwave applicator reduces a moisture level in the green honeycomb structure by less than 10%.

4. The method of claim 1, further comprising supporting the green honeycomb structure on an air bearing while the green honeycomb structure is being exposed to the microwave energy.

5. The method of claim 1, further comprising cutting the green honeycomb structure transversely after exposure to the microwave energy.

6. The method of claim 1, further comprising drying the green honeycomb structure after the green honeycomb structure emerges from the microwave applicator.

7. The method of claim 1, further comprising firing the green honeycomb structure into a ceramic honeycomb structure.

8. The method of claim 1 wherein the microwave applicator assembly comprises a microwave applicator having a processing chamber in which one or more green honeycomb structures are disposed and which contains air, the applicator having an outer diameter D, wherein the one or more green honeycomb structures and the air in the processing chamber have an effective volume weighted average relative permittivity, $\in_{reff}$, wherein $$\frac{10.5199\times 3\times 10^8}{2450\times 10^6\times \pi\sqrt{\varepsilon_{reff}}} > D > \frac{10.1735\times 3\times 10^8}{2450\times 10^6\times \pi\sqrt{\varepsilon_{reff}}}.$$

9. The method of claim 1 wherein the microwave applicator assembly comprises a microwave applicator, wherein the microwave energy in the applicator has a free-space wavelength, and wherein the applicator has an axial length in a range from 50% to 70% of the free-space wavelength.

* * * * *